United States Patent [19]

Doi et al.

[11] Patent Number: 5,071,501

[45] Date of Patent: Dec. 10, 1991

[54] METHOD FOR WRAPPING ROLL-LIKE ARTICLE

[75] Inventors: Yoshimichi Doi; Yasunori Hori; Takanori Endo; Naoyuki Kameyama, all of Shizuoka, Japan

[73] Assignee: Fuji Photo Film Co., Ltd., Kanagawa, Japan

[21] Appl. No.: 620,126

[22] Filed: Nov. 30, 1990

[30] Foreign Application Priority Data

Dec. 5, 1989 [JP] Japan ..... 1-316265

[51] Int. Cl.[5] ..... B31C 11/00; B65B 11/00; B65H 81/00

[52] U.S. Cl. ..... 156/187; 156/190; 156/446; 156/475; 156/468; 53/204; 53/580

[58] Field of Search ..... 53/204, 226, 580, 581, 53/582, 587; 156/184, 187, 188, 190, 215, 443, 446, 468, 475

[56] References Cited

U.S. PATENT DOCUMENTS

| | | | |
|---|---|---|---|
| 2,182,700 | 12/1939 | Muller | 53/580 |
| 2,638,725 | 5/1953 | Hurter et al. | 53/580 |
| 2,962,162 | 11/1960 | Crawford et al. | 206/59 |
| 2,998,049 | 8/1961 | Winslow | 156/475 |
| 4,400,228 | 8/1983 | Gentry | 156/184 |
| 4,524,562 | 6/1985 | Yagi et al. | 53/204 |
| 4,625,493 | 12/1986 | Yagi et al. | 53/204 |
| 4,736,567 | 4/1988 | Pienta | 53/137 |
| 4,845,919 | 7/1989 | Fujii et al. | 53/204 |

*Primary Examiner*—David A. Simmons
*Assistant Examiner*—Jeffrey G. Payne
*Attorney, Agent, or Firm*—Sughrue, Mion, Zinn, Macpeak & Seas

[57] ABSTRACT

A roll-like article has a core and a sheet roll wound around the core so that both side portions of the core projects from both side faces of the sheet roll. A leading end of a wrapping sheet material is fixed to the outer surface of the sheet roll and a leading end of a side face sealing material is fixed to the outer surface of each side portion of the core in a position angularly deviated in one direction from the position in which the leading end of the wrapping sheet material is fixed to the outer surface of the sheet roll. The article is rotated around the core in said one direction by a predetermined angle so that the wrapping sheet material is wound around the sheet roll and the side face sealing material is wound around the core. Each of the side edge portions of the wrapping sheet material projecting from the side faces of the sheet roll is folded along the side face of the sheet roll and the outer portion thereof is pressed against the core. Then the article is rotated around the core in said one direction by another predetermined angle so that the wrapping sheet material is further wound around the sheet roll and the side face sealing material is wound around the outer portion of each of said side edge portions which has been pressed against the core. The last two steps are repeated.

6 Claims, 4 Drawing Sheets

METHOD FOR WRAPPING ROLL-LIKE ARTICLE

BACKGROUND OF THE INVENTION

1. Field of the Invention

This invention relates to a method of and an apparatus for wrapping a roll-like article which comprises a core and a sheet roll wound around the core with at least one side portion of the core projecting from one side face of the sheet roll. This invention also relates a wrapped roll-like article.

2. Description of the Prior Art

Generally sheet in a continuous length is handled in a state of sheet roll in which it is wound around a core. In the case of pressure-sensitive sheet material or the like, the sheet material is wound around a core so that both side portions of the core project from side faces of the sheet roll in order to facilitate subsequent handling.

Such sheet rolls are generally wrapped with a wrapping sheet. In the case of a roll-like article in which a side portion of the core projects from a side face of the sheet roll, it has been difficult to fix the side edge of the wrapping sheet to the side face of the article by an automated system though winding the wrapping sheet around the article and folding the side edges of the wrapping sheet along the side faces of the article have been performed by an automated system.

That a part of the wrapping steps must be manually performed is not preferable in view of improvement of production efficiency and cost reduction.

A roll-like article in which the core does not project from the side faces of the sheet roll has been wrapped by a fully automated system. Such fully automated systems are disclosed, for instance, in Japanese Unexamined Patent Publication Nos. 48(1973)-33987, 54(1979)-40785 and 59(1984)-74020 and Japanese Unexamined Utility Model Publication Nos. 49(1974)-129967 and 51(1976)-150963. However, it is difficult to wrap the roll-like article in which the side portion of the core projects from the side face of the sheet roll by modifications of the wrapping systems for the roll-like article in which the core does not project from the side faces of the sheet roll, or an attempt to wrap the roll-like article in which the side portion of the core projects from the side face of the sheet roll by modifications of the wrapping systems for the roll-like article in which the core does not project from the side faces of the sheet roll will lead to cumbersome and complicated wrapping system. Especially, it is true when vinyl sheet which is cheap but has elasticity is employed as the wrapping sheet.

SUMMARY OF THE INVENTION

In view of the foregoing observations and description, the primary object of the present invention is to provide a method of wrapping a roll-like article, in which the core projects from one or both of the side faces of the sheet roll, which makes it feasible to wrap such an article by an automated system which is relatively simple in structure and which permits use of cheap wrapping sheet.

Another object of the present invention is to provide an apparatus for carrying out the method of the present invention.

Still another object of the present invention is to provide a wrapped roll-like article which is wrapped by the method of the present invention.

In accordance with one aspect of the present invention, there is provided a method of wrapping a roll-like article having a core and a sheet roll wound around the core so that both side portions of the core projects from both side faces of the sheet roll, said method comprising a first step of fixing a leading end of a wrapping sheet material to the outer peripheral surface of the sheet roll so that both side edge portions of the wrapping sheet material project from the both side faces of the sheet roll in a direction parallel to the longitudinal axis of the core, a second step of fixing a leading end of a side face sealing material to the outer peripheral surface of each of said both side portions of the core in a position angularly deviated in one direction from the position in which the leading end of the wrapping sheet material is fixed to the outer peripheral surface of the sheet roll as viewed in the longitudinal axis of the core, a third step of rotating the roll-like article around the longitudinal axis of the core in said one direction by a predetermined angle so that the wrapping sheet material is wound around the sheet roll and the side face sealing material is wound around the core, a fourth step of pressing each of the side edge portions of the wrapping sheet material projecting from the side faces of the sheet roll so that the inner portion of the side edge portion is folded along the side face of the sheet roll and the outer portion thereof is pressed against the core, a fifth step of rotating the roll-like article around the longitudinal axis of the core in said one direction by another predetermined angle so that the wrapping sheet material is further wound around the sheet roll and the side face sealing material is wound around the outer portion of each of said side edge portions which has been pressed against the core, a sixth step of alternately repeating said fourth and fifth steps until the side face sealing material is wound around the outer portion of each of said side edge portions beyond the trailing end of the wrapping sheet material, and a seventh step of fixing the trailing end of the side face sealing material.

The first and second steps need not be performed in this order but may be performed simultaneously or the second step step may be performed first.

Preferably the method of the present invention further comprises an eighth step of fixing the trailing end of the wrapping sheet material. The sixth and seventh steps need not be performed in this order but may be performed simultaneously or the seventh step step may be performed before the sixth step.

In accordance with another aspect of the present invention, there is provided an apparatus for wrapping a roll-like article having a core and a sheet roll wound around the core so that both side portions of the core projects from both side faces of the sheet roll, said apparatus comprising a first fixing means which fixes a leading end of a wrapping sheet material to the outer peripheral surface of the sheet roll so that both side edge portions of the wrapping sheet material project from the both side faces of the sheet roll in a direction parallel to the longitudinal axis of the core, a second fixing means which fixes a leading end of a side face sealing material to the outer peripheral surface of each of said both side portions of the core in a position angularly deviated in one direction from the position in which the leading end of the wrapping sheet material is fixed to the outer peripheral surface of the sheet roll as viewed in the longitudinal axis of the core, an intermittent driving means which intermittently rotates the roll-like article around the longitudinal axis of the core in said one direction by a predetermined angle at one time so that the wrapping sheet material is wound around the sheet roll and the side face sealing material is wound around the core, a pair of sheet edge pressing means each of which presses one of the side edge portions of the wrapping sheet material projecting from the side faces of the sheet roll so that the inner portion of the side edge portion is folded along the side face of the sheet roll and the outer portion thereof is pressed against the core, and a pair of third fixing means which fix the trailing ends of the respective side face sealing materials.

In accordance with still another aspect of the present invention, there is provided a wrapped a roll-like article comprising a core, a sheet roll wound around the core so that both side portions of the core projects from both side faces of the sheet roll, a wrapping sheet material which is wound around the outer peripheral surface of the sheet roll and is folded along both side faces of the sheet roll so that both side edge portions thereof are wound around the both side portions of the core, one side portion of the wrapping sheet material overlaid on the other side portion, and a pair of side face sealing material each of which is wound around one of the side edge portions of the wrapping sheet material, one end of the side face sealing material extending beyond said the other end portion of the wrapping sheet material and fixed to the outer surface of the core and the other end of the side face sealing material extending said one end portion of the wrapping sheet material and fixed to an underlying portion of the side face sealing material.

DESCRIPTION OF THE PREFERRED EMBODIMENT

Figure 2:
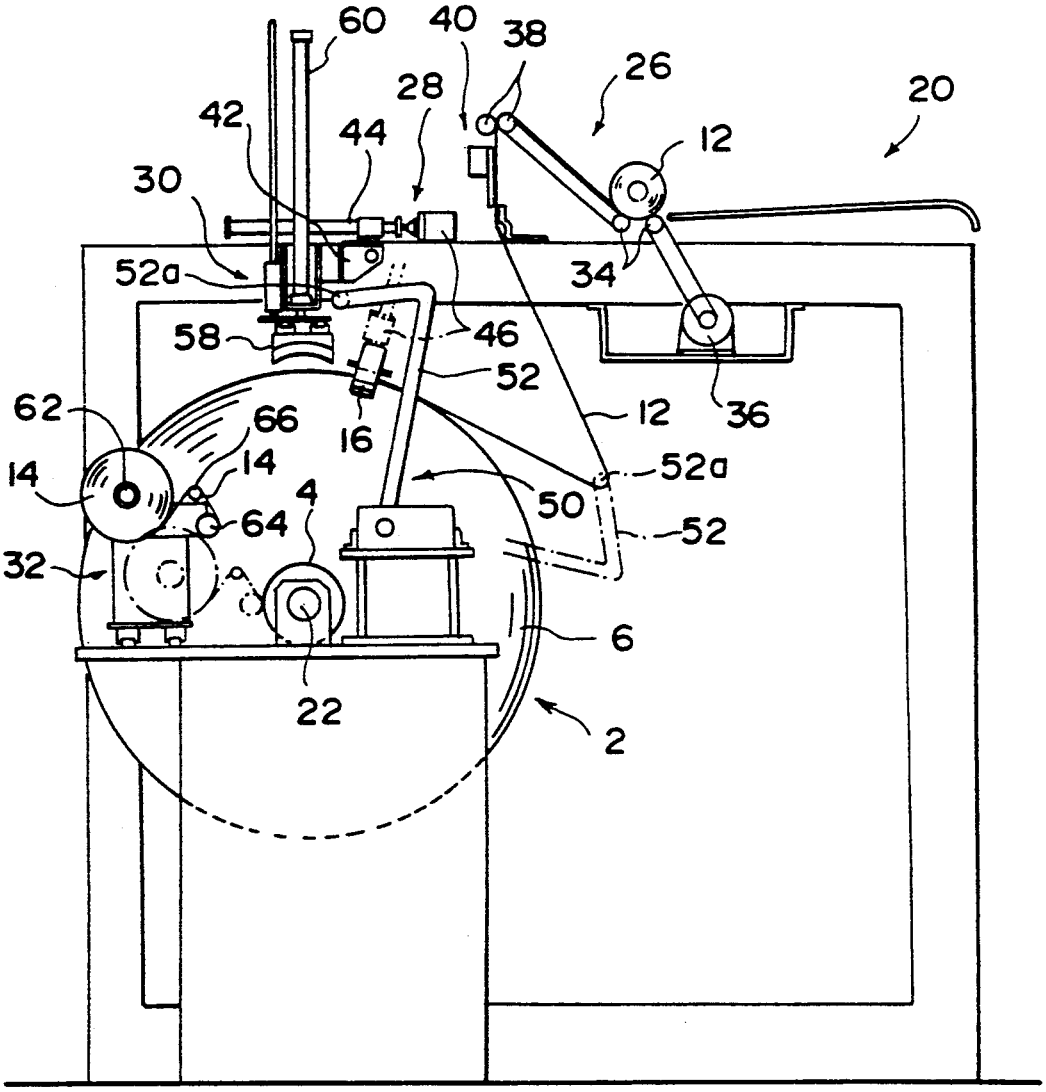
FIG. 2 is a side view of an apparatus for carrying out the method of the embodiment.
Figure 3:
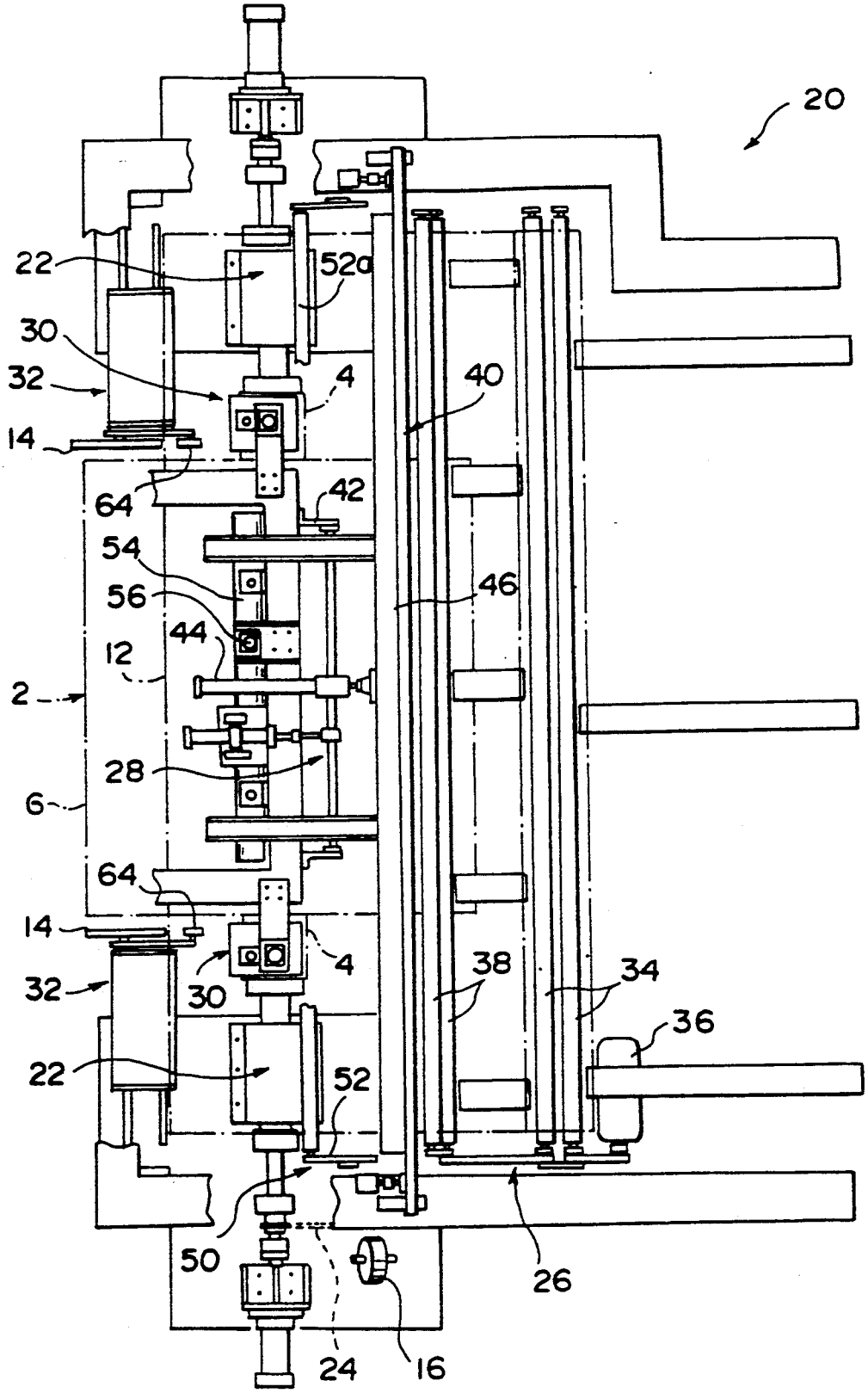
FIG. 3 is a plan view of the apparatus.

In FIGS. 2 and 3, a rollstock 2 comprises a core 4 and and a sheet roll 6 wound around the core 4 with both side portions of the core 4 projecting from both side faces of the sheet roll 6.

A wrapping apparatus 20 for wrapping the rollstock 2 with a vinyl sheet comprises a pair of chucking members 22 which support the rollstock 2 at the respective side faces of the core 4, a driving mechanism 24 which rotates the rollstock 2 around the longitudinal axis of the core 4 30° by 30°, a wrapping sheet feeding mechanism 26 for feeding a vinyl sheet 12 which is larger than the sheet roll 6 in width, a wrapping sheet fixing mechanism 28 which fixes the leading end portion of the vinyl sheet 12 to the outer peripheral surface of the sheet roll 6 with each side edge portion of the vinyl sheet 12 projecting from the side face of the sheet roll 6 by a predetermined width, a pair of sheet edge pressing mechanisms 30 which press the side edge portions of the vinyl sheet 12 projecting from the side faces of the sheet roll 6 against the side portions of the core 4 from the outer surface of the vinyl sheet 12, and a pair of side face sealing member fixing mechanisms 32 for winding the leading end portions of gathering tapes 14, each coated with adhesive on one side thereof, around the side edge portions of the vinyl sheet 12 which have been pressed against the side portions of the core 4.

The wrapping sheet feeding mechanism 26 includes a pair of rollers 34 on which a roll of the vinyl sheet 12 is supported and an electric motor 36 which drives one of the rollers 34 by way of a belt and unrolls the vinyl sheet 12. The unrolled leading end portion of the vinyl sheet 12 is suspended downward from between a pair of rollers 38.

A sheet cutter 40 for cutting the vinyl sheet 12 to a predetermined length is provided below the rollers 38.

The wrapping sheet fixing mechanism 28 comprises a cylinder 44 supported for rotation on a bracket 42 and a suction belt 46 which is mounted on the free end of a piston rod received in the cylinder 44 and extends in parallel to the longitudinal axis of the core 4. The wrapping sheet fixing mechanism 28 draws out a fixing tape 16 to a predetermined length from a fixing tape roll (not shown) with the suction belt 46 in the position shown by the chained lined in FIG. 2, and then swings to the position shown by the solid line in FIG. 2, where the cylinder 44 is operated to apply the fixing tape 16 to the leading end portion of the vinyl sheet 12 so that the fixing tape 16 partly overlaps with the vinyl sheet 12. Then the wrapping sheet fixing mechanism 28 returns to the position shown by the chained line carrying the leading end portion of the vinyl sheet 12 and the cylinder 44 is operated to apply the part of the fixing tape 16 which does not overlap with the vinyl sheet 12 to the outer peripheral surface of the sheet roll 6, thereby fixing the leading end portion of the vinyl sheet 12 to the outer peripheral surface of the sheet roll 6.

A sheet stretching mechanism 50 for facilitating winding the vinyl sheet 12 around the sheet roll 6 is provided near the wrapping sheet fixing mechanism 28. The sheet stretching mechanism 50 includes a pair of sheet stretch levers 52 rotatably mounted on both ends of the sheet roll 6 and a sheet stretch roll **52*a* connected between the sheet stretch levers 52. When the sheet stretch levers 52 rotates by about 90° in the clockwise direction in FIG. 2 to the position shown by the chained line from the position shown by the solid line, the vinyl sheet 12 is wound around the sheet roll 6 to some extent by the sheet stretch roll 52*a*. There is provided above the sheet roll 6 a holding roller 54 for holding the sheet roll 6 not to be rotated by the tension of the vinyl sheet 12 when the sheet stretch levers 52 rotates to the position shown by the chained line. The holding roller 54 is moved up and down by a cylinder 60**.

Each of the sheet edge pressing mechanisms 30 is provided above the corresponding side portion of the core 4 and comprises a pressing head 58 having a concave surface which is substantially equal to the core 4 in curvature, and a cylinder 60 which moves up and down the pressing head.

Each of the side face sealing member fixing mechanisms 32 comprises a support roller 62 which supports a roll of the gathering tape 14, a holding roller 64 which holds the leading end portion of the gathering tape 14, and a guide roller 66 which is disposed between the rollers 62 and 64. The rollers 62, 64 and 66 are movable to the position shown by the chained line where the holding roller 64 abuts against the core 4.

The operation of the wrapping apparatus 20 which carries out the method of wrapping a rollstock in accordance with an embodiment of the present invention will be described in detail with reference to FIGS. 1A to 1F, hereinbelow.

Figure 1A:
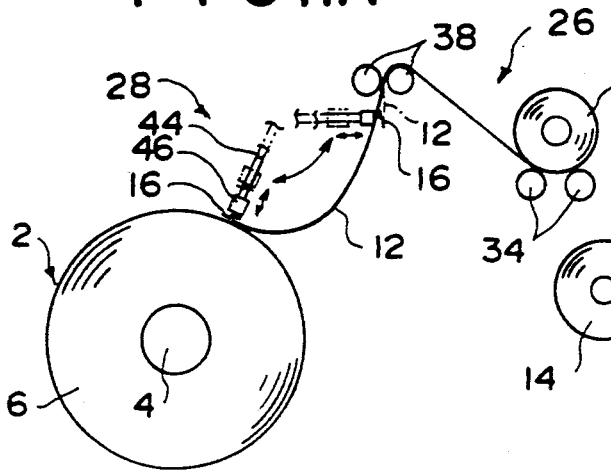
FIGS. 1A to 1F are views for illustrating the method of wrapping a rollstock in accordance with an embodiment of the present invention.
Figure 1D:
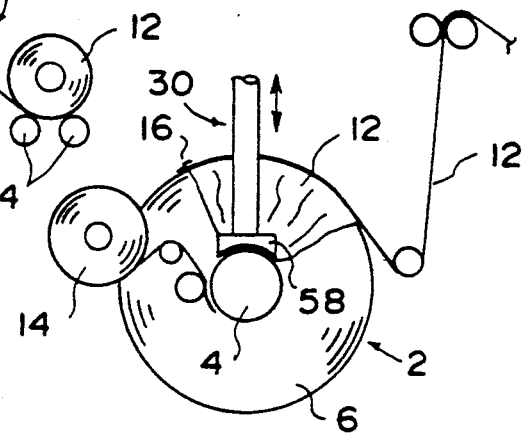

As shown in FIG. 1A, when a fixing tape 16 of a predetermined length is fed to the suction belt 46 of the wrapping sheet fixing mechanism 28, the suction belt 46 is counterclockwisely rotated together with the cylinder 44 and then the cylinder 44 is operated to apply the fixing tape 16 to the leading end portion of the vinyl sheet 12 suspended from the rollers 38 of the wrapping sheet feeding mechanism 26 so that the fixing tape 16 partly overlaps with the vinyl sheet 12. Then the wrapping sheet fixing mechanism 28 returns to the original position shown by the chained line carrying the leading end portion of the vinyl sheet 12 and the cylinder 44 is operated to apply the part of the fixing tape 16 which does not overlap with the vinyl sheet 12 to the outer peripheral surface of the sheet roll 6, thereby fixing the leading end portion of the vinyl sheet 12 to the outer peripheral surface of the sheet roll 6. At this time, the wrapping sheet feeding mechanism 26 feeds the vinyl sheet 12 so that both side edge portions of the vinyl sheet 12 projects from the side faces of the sheet roll 6 by the same width.

Figure 1B:
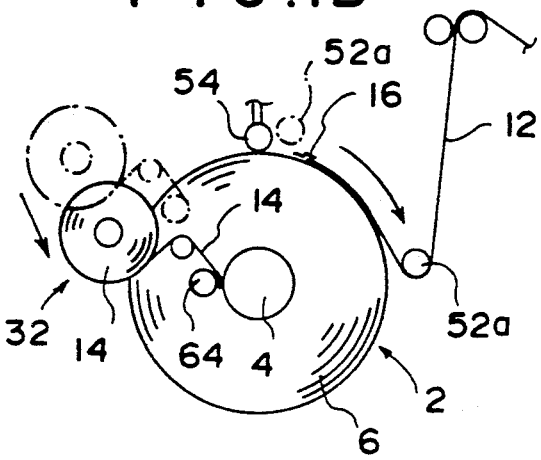

Then the holding roll 54 is moved downward to abut against the sheet roll 6 to hold the rollstock 2 not to rotate as shown in FIG. 1B, and then the sheet stretching levers 52 rotate clockwisely to move the sheet stretch roll 52*a* to the position shown by the solid line from the waiting position shown by the chained line, whereby the leading end portion of the vinyl sheet 12 is wound around the sheet roll 6 to a predetermined length. At the same time, the side face sealing member fixing mechanisms 32 operate to apply the leading end portions of the gathering tapes 14 supported on the support roller 64 to the outer surface of the core 4. As can be understood from FIG. 1B, the leading end of each of the gathering tapes 14 is applied to the outer peripheral surface of the side portions of the core 4 in a position counterclockwisely deviated from the position in which the leading end of the vinyl sheet 12 is fixed to the outer peripheral surface of the sheet roll 6 as viewed in the longitudinal axis of the core 4.

Figure 1E:
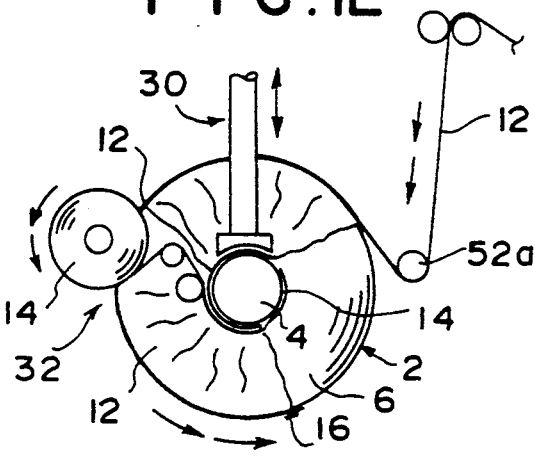
Figure 1C:
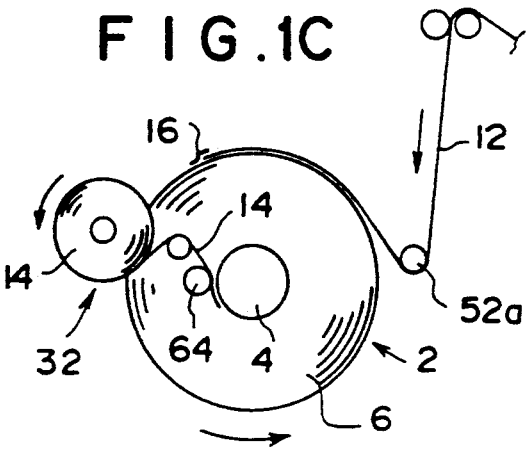

Then the driving mechanism 24 rotates the rollstock 2 by 30° in the counterclockwise direction as shown in FIG. 1C, whereby the vinyl sheet 12 and the gathering tapes 14 are drawn and wound around the sheet roll 6 and the core 4 to predetermined lengths.

Thereafter, the pressing head 58 of the sheet edge pressing mechanism 30 on each side of the sheet roll 6 is moved downward to fold down the edge portion of the vinyl sheet 12 along the side face of the sheet roll 6 and to press the very edge portion against the outer peripheral surface of the core 4. Then the pressing head 58 returns to the original position.

Then the steps described above in conjunction with FIGS. 1C and 1D are repeated, whereby the gathering tape 14 is wound around the very edge portion of the vinyl sheet 12 on the core 4 on each side of the sheet roll 6 as shown in FIG. 1E. After the steps described above in conjunction with FIGS. 1C and 1D are repeated nine times, the sheet cutter 40 (FIG. 2) cuts the vinyl sheet 12 and then the sheet stretch rolls 52*a* is returned to the original position.

Figure 1F:
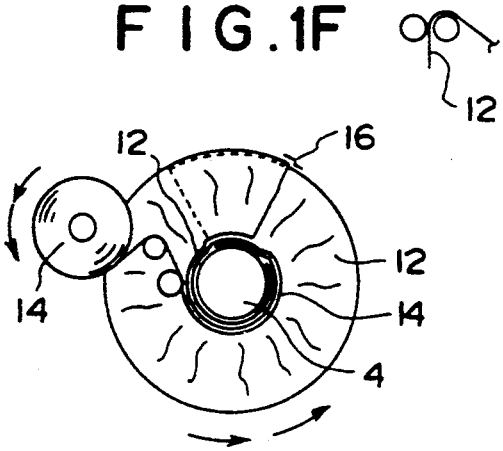

When the steps are further repeated several times, the trailing end portion of the vinyl sheet 12 overlaps with the leading end portion over a predetermined length as shown in FIG. 1F. Then the wrapping sheet fixing mechanism 28 applies the fixing tape 16 to fix the trailing end of the vinyl sheet 12 to the leading end portion thereof.

The rollstock 2 is further intermittently rotated 30° by 30° and the pressing head 58 is moved downward each time the rollstock 2 is stopped, whereby the gathering tapes 14 are further wound until the rollstock is intermittently rotated nineteen times in total. Then the gathering tapes 14 are cut by a cutter (not shown). In this state, the trailing end portion of each gathering tape 14 overlaps with the leading end portion thereof and is bonded thereto.

Figure 4:
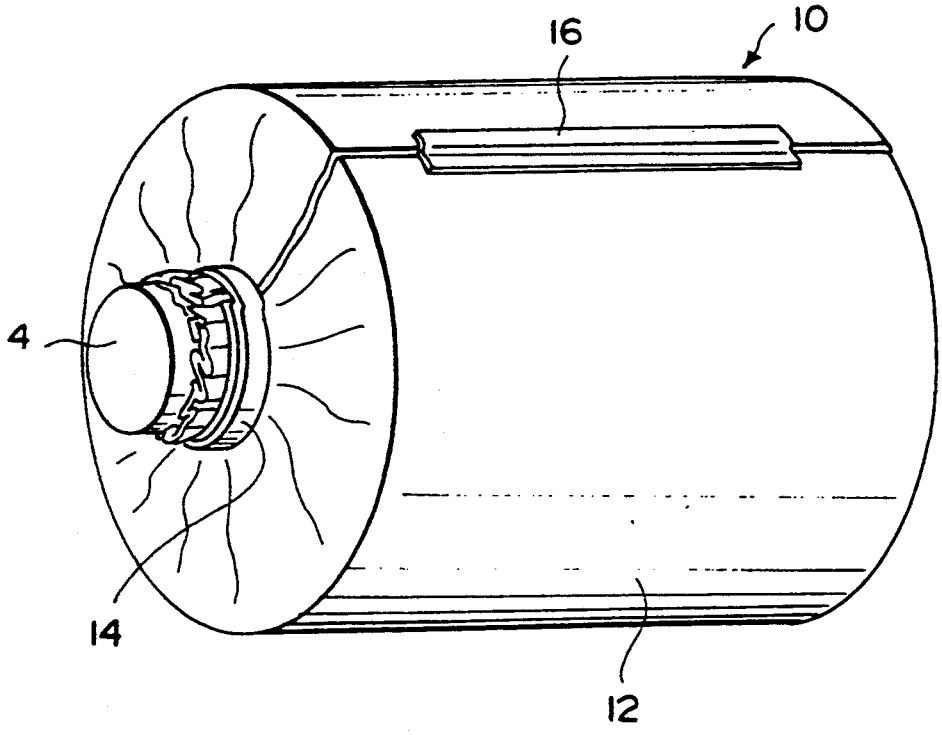
FIG. 4 is a perspective view of a rollstock wrapped by the apparatus shown in FIGS. 2 and 3.

FIG. 4 shows the wrapped rollstock thus obtained.

As can be understood from the description above, in accordance with the method or the apparatus of this embodiment, a roll-like article to be wrapped can automatically wrapped with a simple mechanism, whereby the productivity in the wrapping step can be improved and the manufacturing cost can be lowered.

Further, in accordance with this embodiment, since the wrapping sheet is wound around the article to be wrapped a predetermined angle by a predetermined angle, even a wrapping sheet which is hard to conform to the shape of the article to be wrapped due to elasticity of the sheet can be surely wrapped around the article. Accordingly vinyl sheet which is cheap can be employed as the wrapping sheet.

The wrapping sheet need not be limited to vinyl sheet but may be other sheet materials such as polyethylene sheet, polypropylene sheet or the like.

Further, though, in the embodiment described above, the gathering tape 14 coated with adhesive on one side thereof is employed as the material for sealing the side face of the rollstock, adhesive rubber, string or the like may be employed as the material. Further, tape, rubber, string or the like having no adhesion may be used as the material for sealing the side face of the rollstock. In this case, the leading end and the trailing end of the material is fixed by suitable means such as welding.

In the embodiment described above, the sheet edge pressing mechanism having the pressing head 58 is employed but a compressed-air blower or the like may be used instead of the pressing head 58. Further, the sheet edge pressing mechanism may have two or more such means.

Further, though, in the embodiment described above, the core 4 of the rollstock 2 projects from both side faces of the sheet roll 6, the present invention can be applied to a roll-like article in which the core project from only one side face of the sheet roll.

We claim:

1. A method of wrapping a roll-like article having a core and a sheet roll wound around the core so that both side portions of the core projects from both side faces of the sheet roll, said method comprising a first step of fixing a leading end of a wrapping sheet material to the outer peripheral surface of the sheet roll so that both side edge portions of the wrapping sheet material project from the both side faces of the sheet roll in a direction parallel to the longitudinal axis of the core, a second step of fixing a leading end of a side face sealing material to the outer peripheral surface of each of said both side portions of the core in a position angularly deviated in one direction from the position in which the leading end of the wrapping sheet material is fixed to the outer peripheral surface of the sheet roll as viewed in the longitudinal axis of the core, a third step of rotating the roll-like article around the longitudinal axis of the core in said one direction by a predetermined angle so that the wrapping sheet material is wound around the sheet roll and the side face sealing material is wound around the core, a fourth step of pressing each of the side edge portions of the wrapping sheet material projecting from the side faces of the sheet roll so that the inner portion of the side edge portion is folded along the side face of the sheet roll and the outer portion thereof is pressed against the core, a fifth step of rotating the roll-like article around the longitudinal axis of the core in said one direction by another predetermined angle so that the wrapping sheet material is further wound around the sheet roll and the side face sealing material is wound around the outer portion of each of said side edge portions which has been pressed against the core, a sixth step of alternately repeating said fourth and fifth steps until the side face sealing material is wound around the outer portion of each of said side edge portions beyond the trailing end of the wrapping sheet material, and a seventh step of fixing the trailing end of the side face sealing material.

2. A method as defined in claim 1 further comprising an eighth step of fixing the trailing end of the wrapping sheet material.

3. A method as defined in claim 2 in which said side face sealing material is an adhesive tape coated with adhesive on one side thereof and the leading end of the side face sealing material is fixed to the outer peripheral surface of the core by the adhesive.

4. A method as defined in claim 3 in which the trailing end of said side face sealing material is fixed to an underlying portion of the side face sealing material by the adhesive.

5. A method as defined in claim 2 in which the leading end portion of said wrapping sheet material is fixed to the outer peripheral surface of the sheet roll with an adhesive tape.

6. A method as defined in claim 3 in which the trailing end of said wrapping sheet material is fixed to an underlying portion thereof with an adhesive tape.

* * * * *